United States Patent [19]

Kulig

[11] 4,144,966

[45] Mar. 20, 1979

[54] ARTICLE CARRIER

[75] Inventor: Francis V. Kulig, Morris, Ill.

[73] Assignee: Federal Paper Board Co., Inc., Montvale, N.J.

[21] Appl. No.: 853,224

[22] Filed: Nov. 21, 1977

[51] Int. Cl.[2] ..... B65D 75/00

[52] U.S. Cl. ..... 206/188; 229/28 BC; 229/52 BC

[58] Field of Search ..... 206/188, 189, 190; 229/52 BC, 15, 28 BC, 29 D

[56] References Cited

U.S. PATENT DOCUMENTS

| | | | |
|---|---|---|---|
| 2,984,383 | 5/1961 | Arneson | 206/190 |
| 3,104,027 | 9/1963 | Kulig | 229/28 BC |
| 3,168,211 | 2/1965 | Petter | 206/190 |
| 3,400,856 | 9/1968 | Arneson | 206/188 |
| 3,709,400 | 1/1973 | Arneson | 229/52 BC |
| 3,722,738 | 3/1973 | Wright | 206/190 |
| 3,857,483 | 12/1974 | Wood | 206/188 |
| 4,010,847 | 3/1977 | Wood et al. | 206/190 |

*Primary Examiner*—Herbert F. Ross
*Attorney, Agent, or Firm*—Guy A. Greenawalt

[57] ABSTRACT

A collapsible carrier for bottled beverages which is formed from a blank of paperboard, or similar material, cut and creased so that it may be folded and glued to provide, when set up, a bottom, upstanding side and end walls and a handle and partition structure which includes a multi-ply, longitudinal center partition and cross partitions on opposite sides thereof which divide the carrier into upwardly opening bottle receiving cells with the cross partitions being taken from the material forming the longitudinal partition and providing two plies of the blank material between points of bottle contact and with the center partition providing at least two plies of material between pairs of bottles and including a reinforcing panel which is folded upwardly from a hinged connection with a longitudinal partition panel and which is also folded upon itself.

8 Claims, 11 Drawing Figures

ARTICLE CARRIER

BACKGROUND OF THE INVENTION

This invention relates to article carriers of a type which are fabricated from a single blank of sheet material, with the blank being cut and creased so as to divide the same into a plurality of panels which are folded and secured in predetermined relation and which provide, when in an article receiving position, twin compartments separated by a longitudinally extending center partition and handle structure, with each compartment being subdivided into a plurality of article accommodating cells by cross partitions extending in longitudinally spaced relation between the center partition structure and oppositely disposed sidewalls of the carrier.

Cellular basket type carriers have heretofore been designed for use primarily in connection with the marketing of bottled beverages such as soft drinks, beer, and some other bottled products, which carriers have been fabricated from lightweight paperboard stock so as to keep the cost sufficiently low to make it practical, economically, to employ them for a single trip use, for example, when the product is in disposable bottles. Carriers of this general type are disclosed in U.S. Pat. Nos. 3,093,265; 3,104,027; and 3,125,243. These carriers are adapted to be fabricated from a paperboard material of relatively lightweight and are so constructed that the bottles in the individual cells are separated by a thickness of materials sufficient to meet railroad shipping regulations for glass bottle products and permit the use of the carriers in the marketing of beer when the latter is likely to be shipped by rail.

It is a general object of the present invention to provide an improved bottle carrier which is fabricated from a single sheet, or blank, of relatively lightweight flexible paperboard, or similar material, with the blank being cut, scored and folded in a novel manner so as to provide bottle separating partitions, which, in the erected carrier, have a multi-ply thickness of material in areas between the bottles.

It is a more specific object of the invention to provide an improved article carrier which is fabricated from a blank of paperboard, or the like, of minimum size, which is cut, creased and folded to provide oppositely disposed sidewalls, a longitudinal partition and handle structure paralleling the sidewalls and cross partition members which are derived from end portions of certain of the longitudinal partition panels and which extend between the latter and the sidewalls when the carrier is in erected condition, with the cross partitions having portions folded upon each other so as to provide a double thickness of material between the articles in adjoining cells and the longitudinal partition structure having panel portions in the areas between the cells and on opposite sides thereof which afford a multiple thickness of material for separating the articles.

It is a further object of the invention to provide a twin compartment, multi-cellular collapsible bottle carrier formed from a rectangular sheet of paperboard of relatively light weight, which is cut and scored, or creased, to provide a bottom wall forming panel, sidewall forming panels hinged to opposite side edges thereof, pairs of end wall and longitudinal partition and handle forming panels hinged to the opposite side edges thereof, pairs of end wall and longitudinal partition and handle forming panels hinged to ends of the respective sidewalls, which include a reinforcing panel cut from the material at a side of the blank and folded upwardly from an integral hinge connection with a longitudinal partition and handle panel and which provide, at least, a double thickness of material between the bottles in the center cells.

Still another object of the invention is to provide in an article carrier of the character described a partition structure which includes a multi-panel, longitudinal partition and handle structure having hand holes cut in a top portion thereof and a cross partition panel structure wherein panels forming the cross partition structure are derived, at least in part, from the material cut out to form hand holes in the longitudinal handle forming structure.

To this end the invention which is claimed herein comprises a multi-cell article carrier for bottles, or the like, which is formed from a single blank of foldable sheet material and which includes, when erected, a bottom wall, side and end walls upstanding from the bottom wall and a hingedly connected, multipanel, longitudinal partition and handle forming structure which is hinged at opposite ends to the end walls and which divides the carrier into twin compartments, and cross partition members extending in spaced relation at opposite sides of the longitudinal partition structure which divide each of said compartments into a multiplicity of upwardly opening cells, wherein the cross partition members are hingedly connected to the ends of panel members in the longitudinal partition and handle structure and are secured in partition forming relation to oppositely disposed sidewalls, with sections thereof being derived from material cut out to form hand accommodating holes in the handle forming portions of the longitudinal partition and handle structure.

The aforesaid objects and advantages of the invention will become more apparent when reference is made to the accompanying detailed description of the preferred embodiment of the invention which is set forth therein by way of example and shown in the accompanying drawings wherein like reference numerals indicate corresponding parts throughout.

Figure 1:
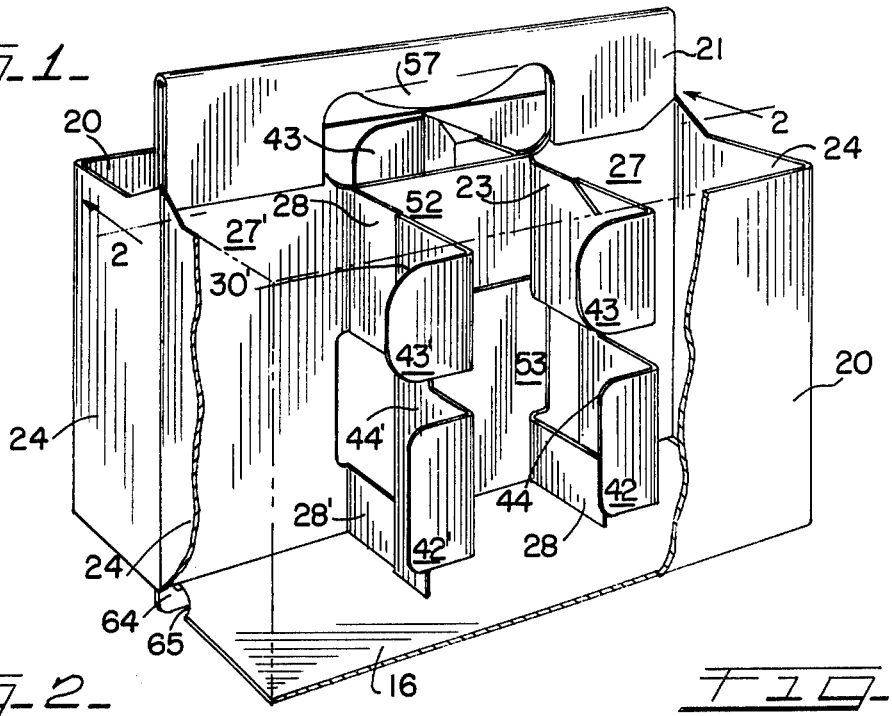
FIG. 1 is a perspective view of an article carrier having embodied therein the principal features of the invention, the carrier being shown in set-up, empty condition and with portions of the sidewall and adjoining end wall broken away.
Figure 2:
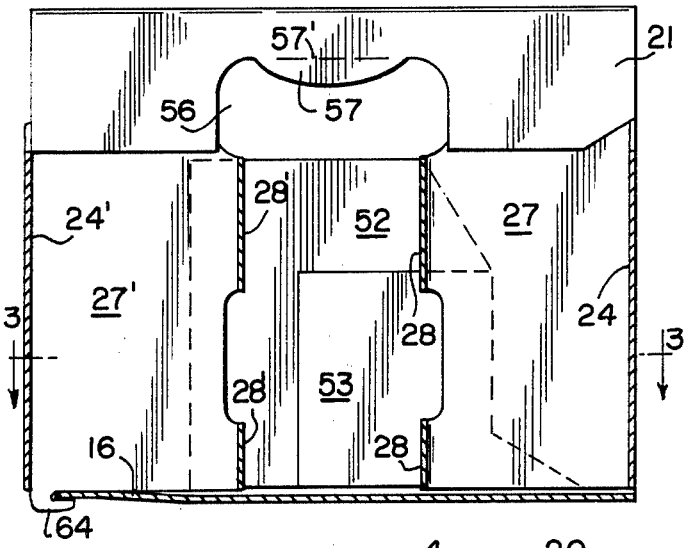
FIG. 2 is a longitudinal vertical section taken on the lines 2—2 of FIG. 1.
Figure 4:
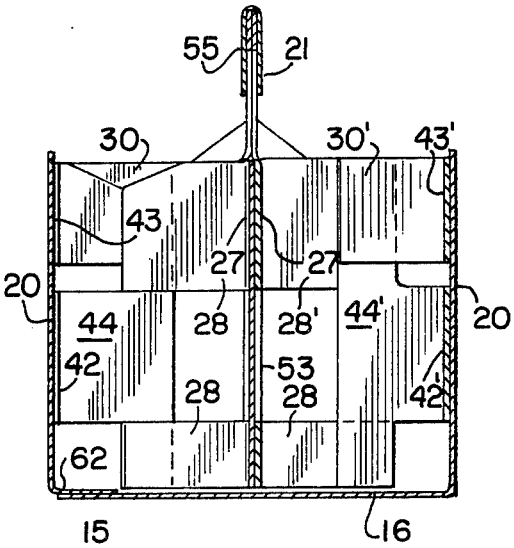
FIG. 4 is a horizontal cross section taken on the line 4—4 of FIG. 2.
Figure 3:
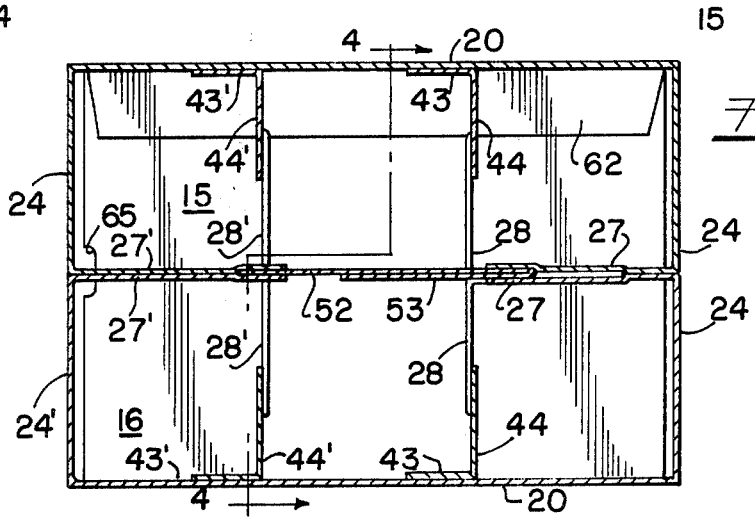
FIG. 3 is a transverse section taken on the line 3—3 of FIG. 2.

Referring to the drawings, there is illustrated one embodiment of the carrier which incorporates the principles of the invention. The carrier is fabricated from a blank 10 (FIG. 5) of suitable sheet material, for example, flexible paperboard which is of a generally rectangular outline and which is relatively thin, for example, having a thickness of 0.020 inch, commonly referred to in the paperboard industry as 20. stock. The blank may be cut from a printed web with suitable nesting to avoid excessive waste. The blank is cut and scored to divide the same into wall and partition panels which are thereafter folded and secured together by a suitable adhesive to form the carrier of FIG. 1. Since the cut and scored blank 10 is to a large extent symmetrical about the longitudinal and transverse lines a—a and b—b, respectively, corresponding elements which are found on opposite sides of the longitudinal line a—a will be designated by the same reference numerals and where an element found on one side of transverse lines b—b has a counterpart on the other side thereof it will be designated by the same reference numeral primed.

Blank 10 is divided in the longitudinal direction into three sections with the center section A and the two end sections B and B' having approximately the same dimensions in the longitudinal direction of the blank. The center section A is subdivided to provide the carrier bottom wall, the sidewalls and a portion of the handle cover panel while the end sections B and B' are subdivided to provide end walls and a combination partition and handle structure. The center section A is separated from the end sections B and B' by transversely extending score lines 11 and 11' and the main body of the center section A is separated from the bottom wall forming panel 12 by a longitudinally extending score line 13 with the panel 12 constituting a side extension.

The bottom wall forming panel 12 is subdivided by the longitudinally extending score line 14, which is parallel with and spaced outboard of the score line 13, to divide the panel into two halves 15 and 16, which are adapted to fold upon each other on the line 14 in collapsing the carrier. The bottom forming panel 12 is separated from an adjoining side extension of the blank section B by a transverse cutting line 17 which projects outwardly from the end of score line 11 and is slightly offset in the direction of the trasnverse line a—a, the opposite cutting line 17', at the other end of panel 12, being offset inwardly of the score line 11' in the same manner.

The main portion of the center section A of the blank is divided by a pair of cutting lines 18, 18 which extend longitudinally of the blank and which are spaced on opposite sides of the line b—b to provide two sidewall forming panels 20, 20 and a portion of the handle cover panel 21, which will be hereinafter referred to. The cutting lines 18, 18 extend at 22, 22 and 22', 22' into the blank sections B, B' equal distances from the transverse line a—a and terminate at transverse score lines 23, 23 and 23', 23' in the blank sections B and B'. The score lines 23, 23 and 23', 23' are spaced from the parallel score lines 11, 11 and 11', 11' a distance equal to half the width of the carrier when set up and these lines define the edges of end wall panels 24, 24 and 24', 24'. The blank end sections B and B' are divided by longitudinally extending score lines 25 and 25' which coincide with the longitudinal line b—b and which are preferably weakened by perforating or slitting so as to facilitate subsequent folding operations. The score lines 25 and 25', together with the score lines 23, 23 and 23', 23' define four corner sections C, C and C', C' which are further subdivided so as to provide longitudinal partition and handle forming panels and cross partition forming panels.

Each of the corner sections C, C and C', C' is subdivided in an identical manner by parallel longitudinally spaced score lines 26, 26 and 26', 26' to provide similar longitudinal partition and handle forming panels 27, 27 and 27', 27' which adjoin the end forming panels 24, 24 and 24', 24', respectively, and cross partition forming panels 28, 28 and 28', 28' at the end portions thereof. The panels 28, 28 and 28', 28' at the four corners of the blank are cut and scored in an identical manner to provide cross partition members 30, 30 and 30', 30' which hinge on the score lines 31, 31 and 31', 31' in forming the cross partition structures. Only one of these will be described in detail, with corresponding elements in the others being indicated by the same numerals and the same numerals primed. The one panel 28, from which the panel 30 is taken, is cut on a generally U-shaped line with the one leg 32 of the U extending longitudinally of the blank and slightly into the panel 27 to a curved base portion 33 and with the other leg defined by a parallel cutting line portion 34 which extends from the base portion 33 outwardly to a small angled portion 35 running to the transverse score line 31. A score line 36 extends from the end of cutting line portion 34 to the end edge of the blank. Panel 28 is cut further on a generally U-shaped line comprising spaced parallel leg portions 37, 38 and a connecting base portion 40 which extends slightly into the panel 27, the leg portions 37, 38 being generally parallel with the cutting lines 32, 34 and being spaced from the same in the direction of the outer side edge of the blank. The portions of the panel defined by the U-shaped cutting lines are subdivided by transversely aligned score lines 41 which are spaced intermediate the hinge forming score lines 26 and 31, so as to define glue tabs 42 and 43. The score lines 31 form hinge lines enabling the swinging of the marginal strip portion 44 about the lines 31, in a 180° arc so as to bring the strip formation into face-to-face contact with the main portion of the panels 28, as hereinafter described.

A longitudinal partition panel 45 extends at one side of the one corner section C and is cut free of the bottom forming panel 12 on the cutting line 17. The panel 45 is separated from the end wall panel 24 and the cross partition panel 28 by longitudinally extending cutting lines 46 and 47 with a score line 48 connecting the latter and forming an integral hinge connection between the panel 45 and the bottom forming edge of the longitudinal partition panel 27. The longitudinal partition panel 45 is subdivided by cutting line 50 and score line 51 into two sections 52 and 53 which are adapted to be folded upon each other about the hinge forming score line 51, as hereinafter described. The transverse score line 51 is located approximately coincident with the transverse center line of the longitudinal partition panel 27 so that the dimension of the panel portion 52, in the longitudinal direction of the blank, is somewhat greater than the same dimension of panel 53. The panel portion 53 has a dimension transversely of the blank which is approximately two-thirds of the corresponding dimension of the panel 52.

Figure 5:
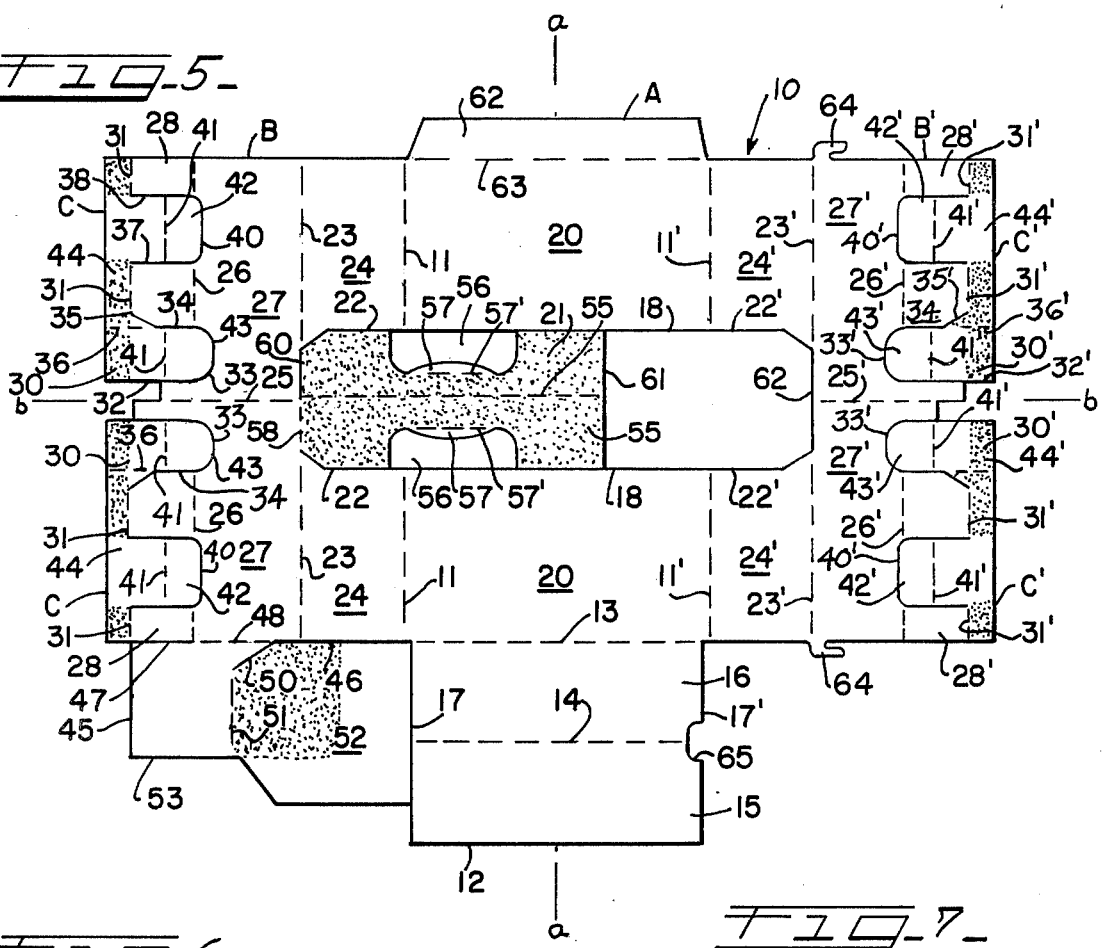
FIG. 5 is a plan view of a paperboard blank which is cut and scored for fabricating the carrier of FIG. 1, with certain areas having an adhesive thereon.
Figure 6:
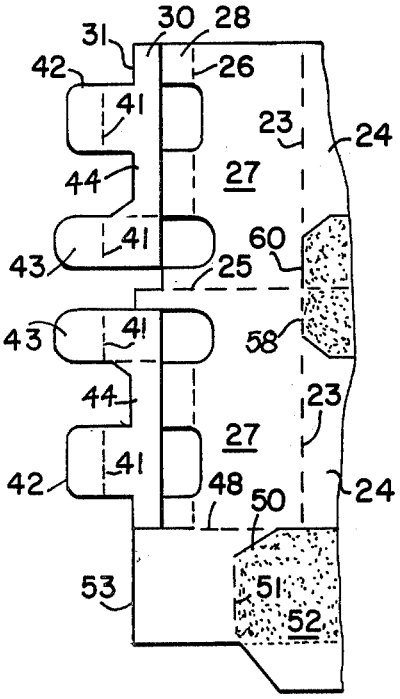
FIG. 6 is a plan view showing one end portion of the blank of FIG. 5 following the first folding and subsequent adhesive applying operations.
Figure 7:
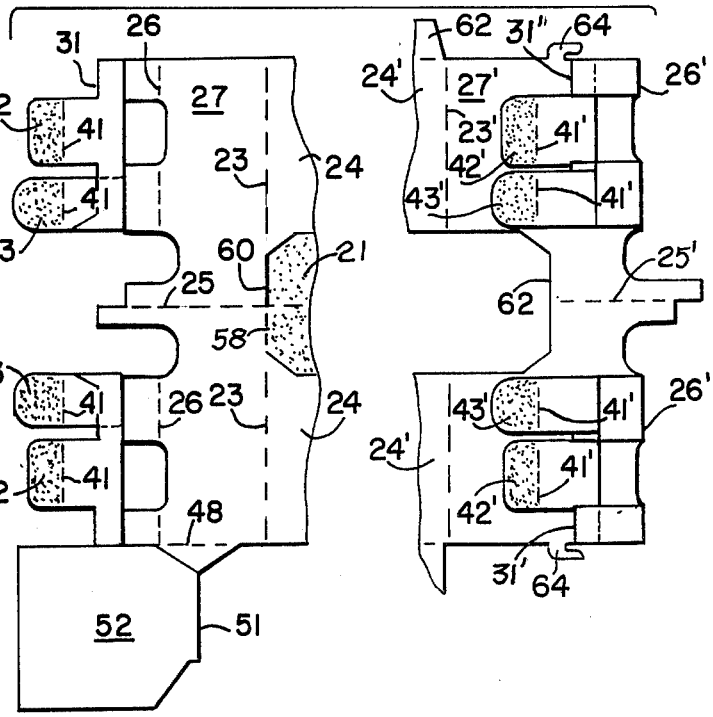
FIG. 7 is a plan view, with portions broken away, showing the blank at a further stage of the adhesive applying and folding thereof.
Figure 8:
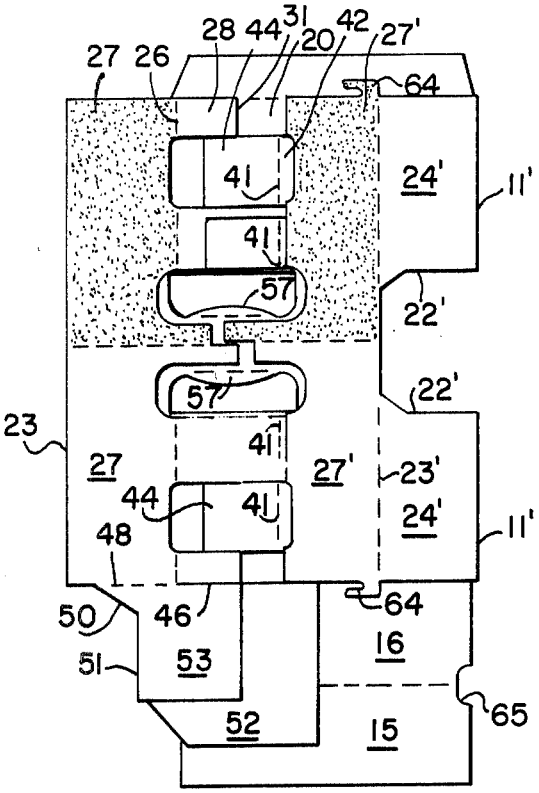
FIGS. 8 and 9 are plan views illustrating seccessive further steps in folding the partition panels into position for final assembly.
Figure 9:
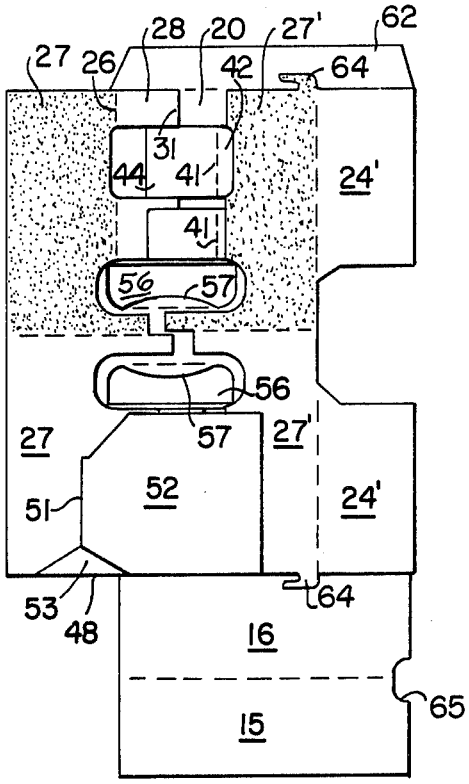
Figure 10:
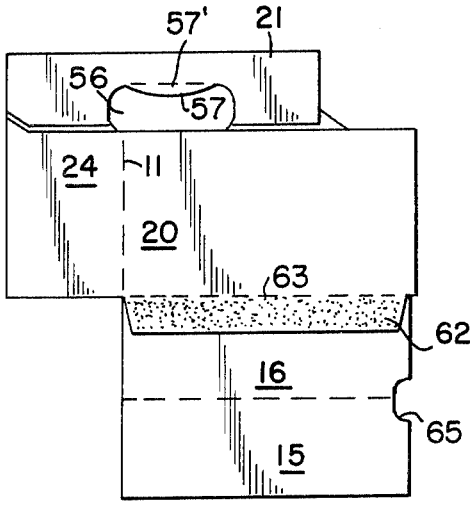
FIG. 10 is a view of the folded carrier except for the last or final folding step.
Figure 11:
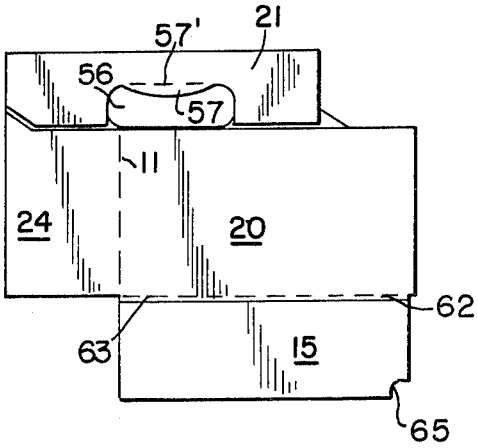
FIG. 11 is a plan view of the completed carrier in the flat, knocked down position.

The handle cover panel 21 which is formed between the cutting lines 18, 18 and 22, 22 is divided into two approximately half sections by a longitudinally extending score line 55. The score line 55 is offset a short distance from the line b—b in the direction of the side edge of the blank and hand accommodating holes 56, 56 are cut in the center areas and along lines 18, 18 with edge reinforcing flaps 57, 57 cut therein and adapted to hinge on score lines 57', 57'. The handle panel 21 remains attached to the one longitudinal petition panel 27 at the end forming score line 58, and is cut free of the associated longitudinal panel 27 on the cutting line 60. A transversely extending cutting line 61 defines the other end of the handle panel 21 with the length of panel 21 corresponding to the length of the sidewall panels 20, 20. The blank material in the area defined by the transverse cutting lines 61, 62, and the spaced parallel longitudinal cutting lines 18, 22', is punched out as waste in forming the blank for the carrier. The blank 10 is cut, scored, and glued, as shown in FIG. 5, and then folded to provide the carrier which is illustrated in FIG. 1. A suitable adhesive is applied to the panels where required, with application being made to permit proper folding in the required sequence. The panels 28', 28' have an adhesive applied in the areas of portions 44', 44', as shown in FIG. 5. In addition, an adhesive is applied to the handle panel 21, and to the longitudinal partition panel 52 as shown. The panel portions 44, 44, and 44', 44' are then folded 180° about the hinge lines 31, 31 and 31', 31', and the panel 52 is folded on score line 51 into face engagement with panel 53, and the glue tab portions and areas 30, 30 and 30', 30' are folded down 180° on the lines 36, 36 and 36', 36', as shown in FIG. 7, after which the panels 28', 28' are folded on the hinge lines 26', 26'. Alternatively, with adhesive applied in the proper areas, the panels 30, 30 and 30', 30' could be folded up 180° on lines 36, 36 and 36', 36'. An adhesive is then applied to the exposed face of each of the glue tab forming portions 42, 42 and 42', 42', and 43, 43 and 43', 43', as shown at the left and right in FIG. 7. The folded end sections of the blank, which are in the position shown in FIG. 7, are now folded about the hinge forming score lines 23, 23 and 11', 11' to bring them into the position shown in FIG. 8. The panels 27, 27 and the accompanying panels are folded first, on lines 23, 23. This brings the folded panel assemblies into engagement with the portion of the blank which forms end wall panels 24, 24 and portions of the sidewall panels 20, 20. The panels 24', 24' and the associated panels 27', 27' with the panels 28', 28' folded thereon as shown in FIG. 7, are folded on the score lines 11', 11' into overlying relation with the center section or sidewall panel forming portions of the blank and portions of the previously folded end panel assemblies. This brings the folded end panel assemblies into the position shown in FIG. 8. An adhesive is then applied to the exposed faces of one pair of end panels 27 and 27', and in addition, to a marginal area of panel 52, as shown in FIG. 8. The panels 52 and 53 are then folded about the score line 48 into the position shown in FIG. 9 with the adhesive bearing marginal portion of panel 52 engaging the innermost margin of the one panel 27'. The panels are folded, finally, about the score line 25, 25' to bring the panels into the position shown in FIG. 10, and the bottom wall forming panels 15 and 16 are folded on the line 14 after applying an adhesive to the panel 62 so as to complete the fabrication of the carrier in collapsed or knocked down condition as shown in FIG. 11. The collapsed carrier is opened up for filling and use by applying pressure to the opposite ends as shown in FIG. 11. The bottom wall forming panels will unfold and the cross partition panels will open out into the position shown in FIG. 1. A hook formation 64 is provided on the bottom edge of the center partition structure for engagement with the end edge of the bottom wall 15, 16, at the recess 65, for holding the carrier in erected condition.

I claim:

1. A multi-cell article carrier for bottles, or the like, which is formed from a single blank of foldable sheet material and which includes, when erected, a bottom wall, side and end walls upstanding from the bottom wall, said end walls being connected on vertical hinge lines to said sidewalls, a multi-panel, longitudinal partition and handle forming structure upstanding from the bottom wall and having a lower partition forming portion and an upper handle forming portion which multi-panel structure is hingedly connected at opposite ends to the end walls on vertical hinge lines at the center of said end walls and divides the carrier into twin compartments, and cross partition members extending in longitudinally spaced relation at opposite sides of said lower partition forming portion of said multi-panel structure which cross partition members divide each of said compartments into a multiplicity of upwardly opening cells, said cross partition members being hingedly connected to the ends of certain of the panel members in the multi-panel longitudinal partition and handle forming structure and being secured in cross partition forming relation to oppositely disposed sidewalls and portions of said cross partition members being derived from material cut out to form hand accommodating holes in said upper handle forming portion of said longitudinal partition and handle structure and being hinged downwardly from the top edge of said cross partition.

2. A multi-cell article carrier, as set forth in claim 1, wherein said cross partition members have a full depth, double thickness of material in the top and bottom margins of the bottle contacting area thereof which is located intermediate the longitudinal partition and handle structure and the associated sidewall and which double thickness of material is in the area which contacts the bottles.

3. A multi-cell article carrier, as set forth in claim 2, wherein the double thickness of material in the top margin of each of the cross partition members is derived from a portion of a panel member in said multi-panel structure, which double thickness of material is hinged downwardly from the top edge of said cross partition member and which includes a glue tab hinged thereto on a vertical hinge line and secured to the associated sidewall.

4. A multi-cell article carrier, as set forth in claim 1, wherein each of said cross partition members includes an outboard end portion extending to the associated sidewall and folded downwardly on a hinge line at the top edge of the cross partition member into double thickness forming relation in the top portion of the bottle contacting area of said cross partition member and which outboard end portion includes an integrally hinged tab member which tab member is attached to the inside face of the associated sidewall of the carrier so as to securely anchor the top portion of the cross partition member to said sidewall.

5. A multi-cell article carrier, as set forth in claim 4, wherein said longitudinal partition and handle forming structure has an upper handle forming portion which extends above the level of the topmost edges of said cross partition members and said outboard end portion of each of said cross partition members is derived from said handle forming portion of said longitudinal partition and handle structure which extends above the top edges of said cross partition members.

6. A multi-cell carrier, as set forth in claim 1, wherein said longitudinal partition and handle structure extends upwardly a substantial distance above the top edges of the opposed sidewalls and has hand accommodating holes cut in the said handle forming upper portion thereof, and said cross partition members have portions derived from material cut to form said hand accommodating holes which portions are each folded on a vertical and on a horizontal hinge line so that a part thereof forms a double thickness of material in a bottle contacting area of the cross partition and another part thereof forms a hinged tab which is connected to the associated sidewall.

7. An article carrier blank of paperboard or like material which is cut and scored for fabricating a cellular article carrier, said blank being generally rectangular and being divided by longitudinal and transversely extending scoring and cutting lines so as to provide a pair of sidewall forming panels and three panels of substantially equal width at opposite ends of said sidewall panels which are divided by longitudinally spaced parallel score lines so as to form an end wall panel, a longitudinal partition panel and a cross partition forming panel at the end thereof, each said cross partition panel being subdivided by transverse cutting and scoring lines into two integrally hinged panel portions which are adapted to fold upon each other about a score line parallel with the score line which connects said cross partition panel with the associated longitudinal partition panel and which is offset relative to the center line of said cross partition panel in the direction of the free edge of the blank so that when folded, the outermost panel portion will overlie corresponding portions of the innermost panel portion and provide at least two thicknesses of material in the center of the folded partition formation, and each of said outermost panel portions having a top marginal portion which is scored on a line extending longitudinally of the blank so as to permit said portion to be folded on said longitudinal score line into overlying relation with adjoining folded portions thereof and form with said adjoining portions three thicknesses of material in the area at the top margin of the cross partition.

8. An article carrier blank as set forth in claim 7, and a pair of longitudinal partition reinforcing panels extending from the bottom forming edge of the said three panels at one end of one of the sidewall forming panels which reinforcing panels are cut and scored so as to fold upon each other and also fold about the bottom forming edge of the associated longitudinal partition panel.

* * * * *